United States Patent [19]

Ruble

[11] 3,987,652

[45] Oct. 26, 1976

[54] UNIDIRECTIONAL AGITATION ACCESSORY FOR AUTOMATIC WASHER

[75] Inventor: Ernest Burlin Ruble, South Haven, Mich.

[73] Assignee: Whirlpool Corporation, Benton Harbor, Mich.

[22] Filed: May 8, 1975

[21] Appl. No.: 575,730

Related U.S. Application Data

[63] Continuation of Ser. No. 418,379, Nov. 23, 1973, abandoned.

[52] U.S. Cl. ..... 68/134; 74/126; 259/99

[51] Int. Cl.[2] ..... D06F 13/00

[58] Field of Search ..... 68/131–134, 68/28, 38, 53, 54, 89, 184, 23.6, 23.7; 259/20, 39, 63, 101, 117, 99; 416/124, 169, 172; 192/46; 74/126

[56] References Cited

UNITED STATES PATENTS

| | | | |
|---|---|---|---|
| 1,704,932 | 3/1929 | Altorfer | 68/133 |
| 1,834,936 | 12/1931 | Bryant | 68/133 |
| 2,253,989 | 8/1941 | Skinner | 68/54 X |
| 2,331,897 | 10/1943 | Dyer | 68/23.7 X |
| 2,734,367 | 2/1956 | Geldhof | 68/133 |
| 3,285,040 | 11/1966 | Bochan | 68/134 |
| 3,330,316 | 7/1967 | MacNeill | 192/46 |
| 3,678,714 | 7/1972 | Krolzick | 68/131 |
| D196,194 | 9/1963 | Krolzick | D49/1 |

*Primary Examiner*—Philip R. Coe

[57] ABSTRACT

An agitator accessory for washing machines having an oscillating vertical-axis agitator, the accessory comprising a sleeve which is securable to the barrel of the agitator in coaxial alignment therewith, the sleeve having a vane means attached thereto. A one-way clutch means is included to rotate the agitator accessory incrementally, during one-half cycles of the oscillatory agitator movement, to thereby force fabrics being washed downward along the agitator and toward vanes extending from the skirt of the agitator.

16 Claims, 4 Drawing Figures

UNIDIRECTIONAL AGITATION ACCESSORY FOR AUTOMATIC WASHER

This is a continuation, of application Ser. No. 418,379, filed Nov. 23, 1973, and now abandoned.

REFERENCE TO RELATED APPLICATION

This application has subject matter in common with the application of Clark I. Platt entitled "Combined Oscillating and Unidirectional Agitator for Automatic Washer" Ser. No. 418,378 filed Nov. 23, 1973, and assigned to the same assignee as the present application.

BACKGROUND OF THE INVENTION

1. Field of the Invention

This invention is in the field of agitating elements for washing machines and provides an agitator accessory consisting of a detachable vaned sleeve structure which cooperates with the agitator vanes in forcing the fabrics being washed downwardly toward said agitator vanes as the agitator oscillates.

2. DESCRIPTION OF THE PRIOR ART

It has been found that the most efficient means for washing clothes within an automatic washing machine having a vertical axis agitator is to provide a substantially continuous cyclical rollover movement pattern of the clothes during washing which involves moving the clothes down along the agitator barrel, then radially outwardly from the oscillating vanes, then upwardly along the wall of the washing basket and inward to the barrel of the agitator, and so forth. Conventional washing machines are reasonably proficient in achieving this type of rollover pattern when light loads are being washed, but not with heavy loads. When the washing basket is tightly packed with clothes the load crowds the agitator and basket area. A conventional oscillating agitator has difficulty in attaining any kind of a rollover to the clothes load under these conditions. The conventional-type agitator may merely scrub the bottom portion of a tightly-packed heavy load, resulting in a very uneven uniformity of cleaning.

There are a few examples in prior patents of agitators which move in separate paths during a washing operation. For example, the Bryant U.S. Pat. No. 1,834,936 suggests dual agitator members which are reciprocated in opposite directions within the tub, the object being to create a violent water action.

The Krolzick U.S. Pat. No. 3,678,714 assigned to the same assignee as the present invention describes a washing machine assembly including a pair of agitators, the two agitators being coupled together for mutual oscillation, but having cam means or the like provided between the two agitators to effect a vertical reciprocation of one with respect to the other during such oscillation.

Dyer U.S. Pat. No. 2,331,897 discloses a washing machine having an agitator provided with a spiral vane on an upper portion, the agitator rotating at motor speed during washing.

Krolzick U.S. Pat. Des. 196,194 assigned to the same assignee as the present invention shows an agitator for a laundry machine wherein the ornamental design for the agitator includes a spiral vane arrangement.

Geldhof U.S. Pat. No. 2,734,367, assigned to a predecessorof the assignee of the present invention, shows an agitator for a laundry machine wherein the agitator includes spiral vanes which extend in the form of radial vanes on their lower edges, with radial projections or vanes extending intermediate the spiral vanes.

SUMMARY OF THE INVENTION

The present invention provides an agitator accessory for use with an automatic washer having a clothes-washing receptacle and drive means for driving a vertical axis agitator in an oscillatory fashion. In the preferred form of the present invention, a sleeve is provided to fit around the barrel of the agitator in coaxial relation therewith, with an auger-like inclined-vane structure being formed on the outer periphery of the sleeve. The upper end of the sleeve may be provided with teeth which are arranged to receive a ratchet ring which is detachably coupled to the agitator barrel for oscillation therewith. Upon oscillatory movement of the agitator the pawls of the ratchet drive the sleeve in one direction of agitator rotation, but not in the other. The inclined vane on the sleeve is configured to urge, deflect or auger clothes within the receptacle downwardly toward the lower-agitator portion where they may be contacted by a set of generally vertically-extending vanes disposed about the skirt portion of the agitator. The agitator accessory thereby acts to feed clothes downwardly along the barrel of the agitator where they come under the influence of the oscillating vertically-positioned agitator vanes on the skirt portion of the agitator which direct the clothes radially outwardly toward the periphery of the basket, and eventually upwardly and back to the barrel of the upper agitator, completing a rollover cycle which is extremely efficient for securing scrubbing contact with the wash liquid.

BRIEF DESCRIPTION OF THE DRAWINGS

Other objects, features and advantages of the invention will be readily apparent from the following description of certain preferred embodiments thereof, taken in conjunction with the accompanying drawings, although variations and modifications may be effected without departing from the spirit and scope of the novel concepts of the disclosure and in which.

DESCRIPTION OF THE PREFERRED EMBODIMENTS

Figure 1:
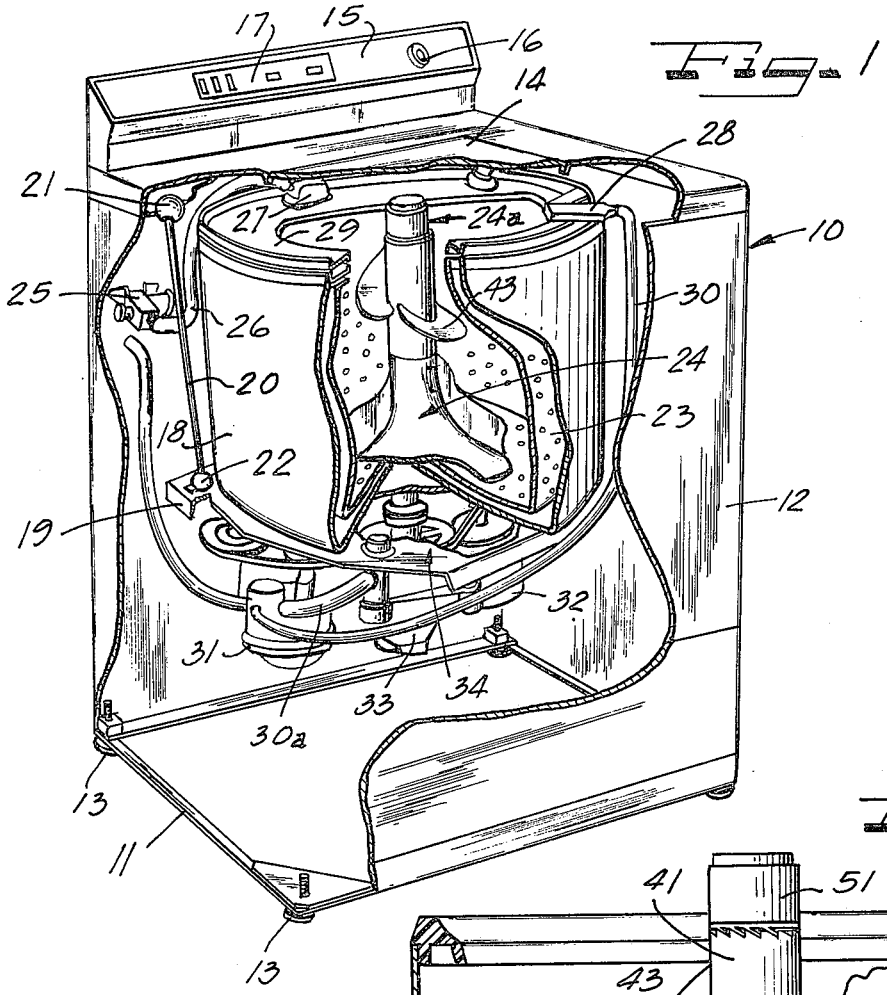
FIG. 1 is a view in perspective, partly broken away, of a conventional type of automatic washing machine which is provided with the improved agitator accessory of the present invention.

In FIG. 1, reference numeral 10 indicates generally a washing machine of the automatic type which includes a frame 11 carrying vertical panels 12 forming the sides, front and back of the machine. The machine 10 is supported by means of threaded legs 13 extending from each of its corners.

The machine also includes a hinged lid 14 providing access to the interior of the washing machine and a console 15 having a timer dial 16 and a program selector 17.

Within the cabinet formed by the vertical panels 12 there is an imperforate tub 18 which is supported within the cabinet by means of a base plate 19. A plurality of suspension rods 20 having resilient spherical end portions 21 and 22 are positioned about the tub 18 to suspend the tub freely within the interior of the cabinet.

A perforate washing basket 23 is positioned concentrically within the tub 18. The improved agitator accessory of the present invention has been designated generally at reference numeral 24*a* and is positioned with the agitator 24 centrally of the perforate basket 23.

Liquid is introduced into the washing machine by means of a solenoid-controlled inlet valve 25 which directs the liquid through an intake conduit 26 and an anti-siphon device 27 into the washing area. A filter 28 is positioned along a tub ring 29 disposed between the tub 18 and the basket 23 and delivers filtered wash water to the tub by means of an outlet conduit 30 fed from the outlet port of a pump 31. The inlet port of the pump 31 is in fluid communication with the tub 18 by means of an inlet conduit 30*a*, thus forming a means for circulating washing liquid through the filter 28 during the agitate cycle of machine operation. The pump 31 as well as the other movable parts of the assembly are driven by means of a motor 32 which operates through a transmission 33. A clutch and brake assembly generally indicated at reference numeral 34 is provided for energizinhg the agitator 24 in an oscillatory fashion during washing, and for disengaging the agitator and engaging means for spinning the basket 23 during the liquid-extraction portion of the washing cycle.

The arrangement shown in FIG. 1 is conventional in vertical-axis washing machines and has been shown for the sake of completeness.

Figure 2:
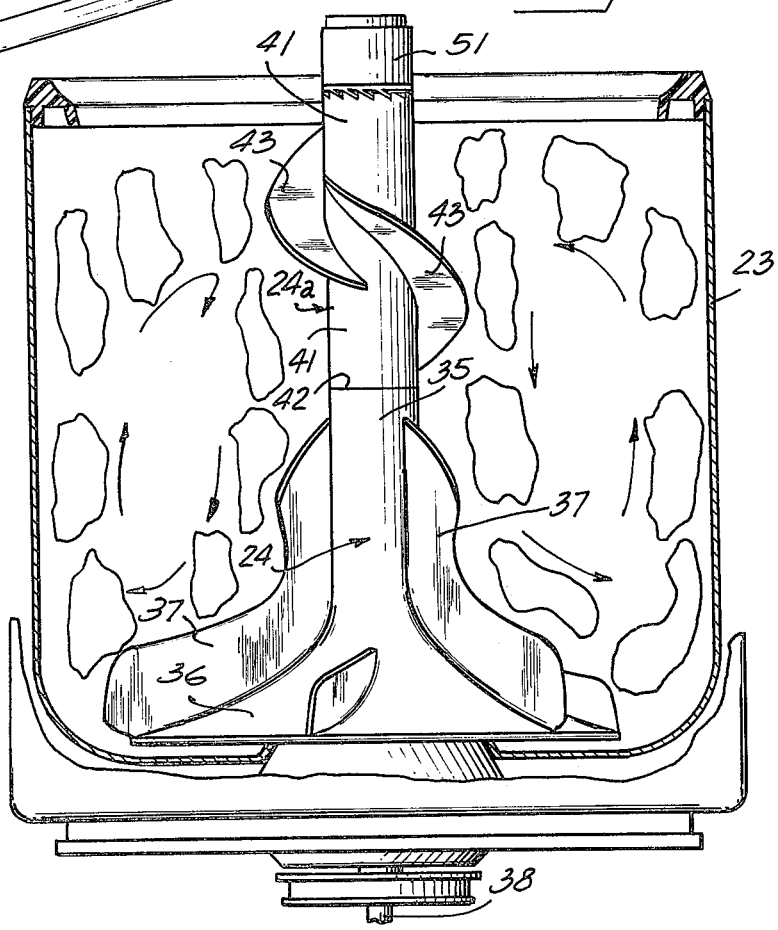
FIG. 2 is a vertical cross-sectional view of the machine during operation, and illustrates the type of rollover pattern which can be achieved through the use of the agitator accessory of the present invention, the washing liquid being omitted and only a partial clothes load being shown for purposes of clarity.
Figure 3:
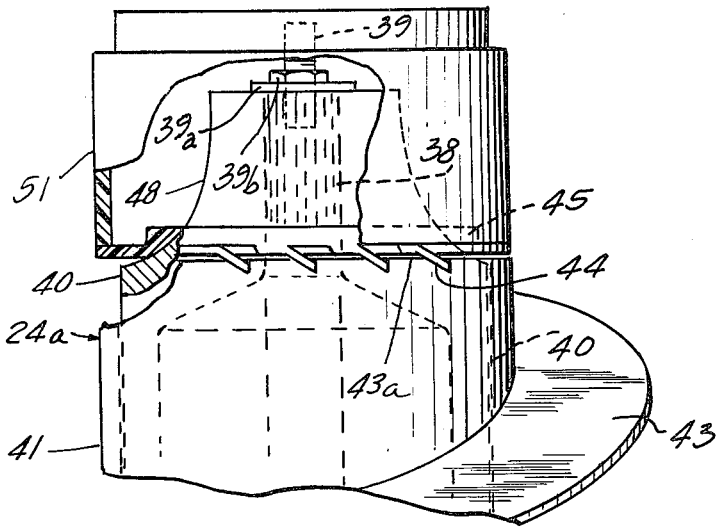
FIG. 3 is a fragmentary elevational view of the agitator accessory of the present invention, partly broken away, illustrating the means by which a unidirectional drive is achieved in the accessory.

Referring now to FIG. 2, it will be seen that the agitator 24 which comprises a first unitary member has an upstanding centerpost or barrel portion 35 and a lower vaned portion or skirt 36 about which are disposed a plurality of generally vertically disposed agitator vanes 37. A splined drive shaft 38 extends through the agitator 24, as shown best in FIG. 3, and is secured at the top of the barrel portion 35 by means of a washer 39*a* and a threaded stud 39. The stud 39 has an integral shoulder portion 39*b* which serves to hold the washer 39*a* and therefore the agitator 24 in place, and the shoulder portion may have a hexagonal shape to facilitate tightening. The top portion of the stud 39 is provided with threads to hold the agitator cap 51 in place at the top of the assembly. When the agitator cap 51 is made up tight on threaded stud 39 the lower portion of the agitator cap circumferentially contacts the top of the ratchet ring 45 and holds it in contact with the top of the sleeve 41, preventing any substantial vertical movement of the ratchet ring or the sleeve with respect to the agitator 24 or with respect to each other.

The upper end of the barrel portion 35 has a reduced diameter portion 40 which is received within and is encompassed by a sleeve 41, a bottom of the sleeve 41 resting on a shoulder 42 of the barrel portion 35. The sleeve 41 has radially outwardly extending vane means associated therewith, in the illustrated embodiment two inclined helical vanes 43 formed about its outer periphery somewhat like an auger such that upon rotation of the sleeve 41 in one direction, the vanes 43 tend to move or auger the clothes downwardly toward the generally vertical agitator vanes 37 as best illustrated in FIG. 2.

Figure 4:
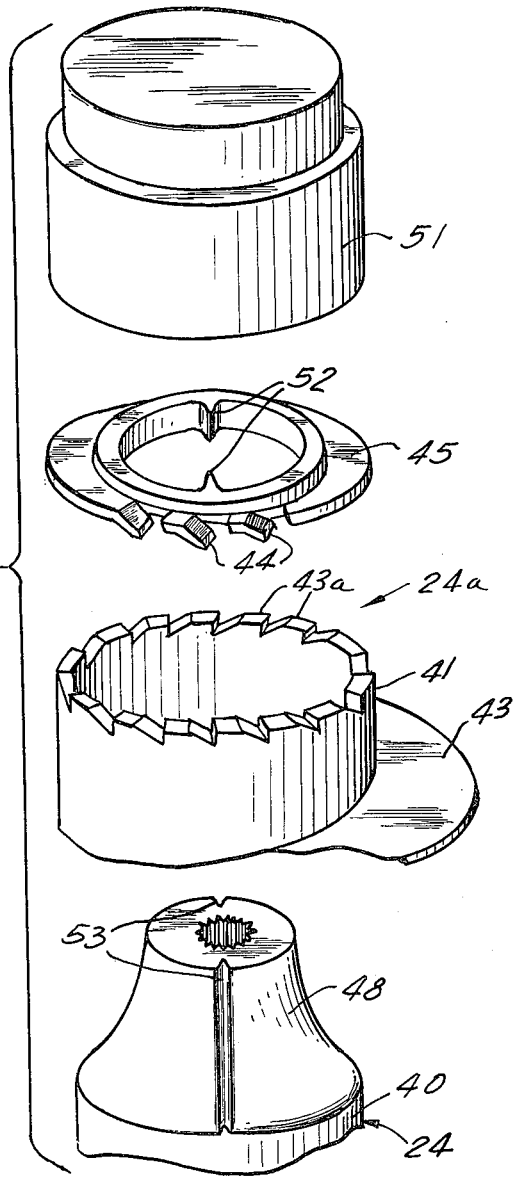
FIG. 4 is an exploded fragmentary view of the agitator accessory and a portion of the agitator barrel.
Figure 1:
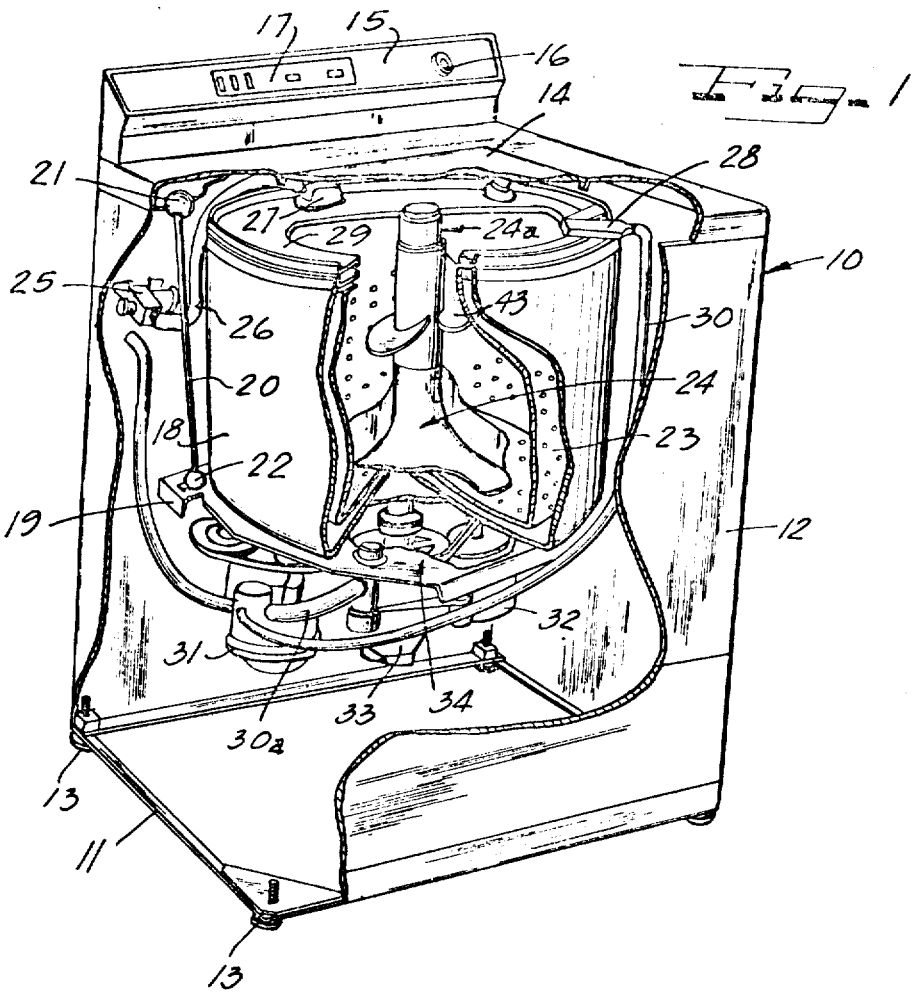
Figure 2:
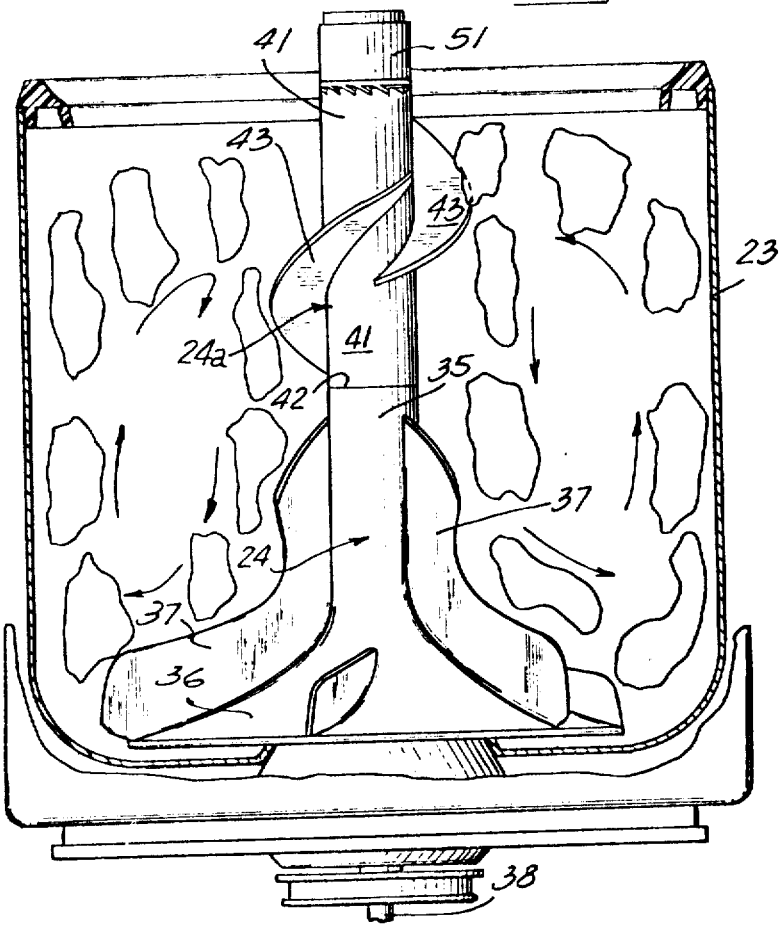

One-way clutch means are provided to cause rotation of the agitator accessory 24*a* in one direction only. In the illustrated embodiment the one-way clutch means comprises a ratchet ring 45 and a series of teeth formed on sleeve 41. The upper end of the sleeve 41 has a plurality of teeth 43*a* around its periphery as best illustrated in the exploded view of FIG. 4. These teeth are arranged to engage pawls 44 extends from ratchet ring 45. The pawls 44 may be somewhat flexible. The upper portion 48 of the agitator barrel is tapered and has vertical grooves 53 formed on opposite sides of the periphery thereof which receive inwardly-projecting tongues 52 of the ring 45. The ratchet ring 45 is thus coupled to the agitator barrel 35 through this tongue and groove arrangement and the two therefore oscillate together.

In operation, as the agitator barrel 35 is oscillated, the flexible pawls 44 on the ratchet ring 45 engage the teeth 43*a* of the sleeve 41 to incrementally rotate the sleeve when movement of the agitator is in the counterclockwise direction. When the washing machine is loaded and the agitator is moved in a clockwise direction, the flexible pawls 44 slip over the teeth due to the frictional drag created on the sleeve 41 by the action of the clothes against the inclined vanes. Thus, as the agitator 24 oscillates the agitator accessory 24*a* including the sleeve 41 and the attached inclined vanes 43 rotates intermittently in the counterclockwise direction. That is, as the agitator 24 oscillates, its counterclockwise movement and only said counterclockwise movement is imparted to the agitator accessory 24*a*. It has been found that this incremental rotation of the inclined vanes 43 tend to create a generally toroidal rollover movement or pattern of the type shown in FIG. 2, that is, the clothes adjacent to the agitator accessory are forced downwardly toward the generally vertical agitator vanes 37 which in turn propel the clothes radially outwardly and upwardly along the inner periphery of the basket 23 and back to the vicinity of the agitator accessory 24*a*. This creates a highly desirable rollover action which subjects the clothes to intimate contact with the washing liquid.

The agitator accessory of the present invention is simple and easy to construct, as all the parts thereof can be made of an easily moldable synthetic resin such as polypropylene. It should also be noted that the agitator accessory is easily removable from the agitator itself so that the machine can be utilized with or without the accessory, depending upon the size of the load being washed.

It will be evident that various modifications can be made to the described embodiments without departing from the scope of the present invention.

I claim:

1. An agitator accessory for a washing machine having a washing receptacle for containing washing liquid and items to be washed and a vertical axis agitator located within said receptacle, said agitator having a barrel portion and a lower portion carrying at leat one substantially vertical vane, said agitator accessory comprising:

a sleeve mounted coaxially with and over the barrel portion of the agitator, vane means extending from the sleeve for urging the items to be washed in the vicinity of said vane means in a downwardly direction, and one-way clutch means for connecting the sleeve with the agitator to incrementally rotate said sleeve in one direction upon oscillatory movement of said agitator to thereby cause the urging of said items in a downwardly direction.

2. An agitator accessory for use in a washing receptacle for containing washing liquid and items to be washed and having a vertical axis agitator located within said receptacle, said agitator having a barrel portion and a lower portion carrying at least one substantially vertical vane, said agitator accessory comprising:

a sleeve mounted coaxially with and over the barrel portion of the agitator, vane means extending from the sleeve for urging the items to be washed in the vicinity of said vane means in a downwardly direction, and one-way clutch means connecting the sleeve with the agitator to incrementally rotate said sleeve in one direction upon oscillatory movement of said agitator to thereby cause the urging of said items in a downwardly direction, the one-way clutch means comprising:

a plurality of teeth circumferentially spaced around the top of the sleeve, a ratchet ring coaxially mounted on the barrel portion of the agitator to oscillate therewith and above the top of the sleeve, said ratchet ring having a plurality of pawls downwardly directed about its periphery and engaging the teeth of said sleeve, and an agitator cap coaxial with and removably connected to the top of the agitator, the bottom of said agitator cap contacting the perimeter of the top of the ratchet ring to restrain the vertical movement of said ring.

3. An agitator accessory as claimed in claim 2, wherein the barrel portion of the agitator has a pair of vertical grooves formed on opposite sides of its upper portion, and wherein the ratchet ring has corresponding inwardly projecting tongues, that ride in said grooves preventing relative rotational motion between said agitator and said ratchet ring.

4. An agitator accessory as claimed in claim 2 wherein the vane means comprises at least one inclined vane rigidly affixed to and extending radially outwardly from the outer perimeter of the sleeve.

5. An agitator accessory for a clothes washing machine for washing items, said machine having an oscillating vertical axis agitator with a barrel portion, said accesory comprising:

a sleeve proportioned to be received over and in coaxial alignment with the barrel portion, vane means associated with the sleeve for urging items in the vicinity of said vane means in a downwardly direction, and one-way clutch means operably connecting the agitator and the sleeve.

6. An agitator accessory for a clothes washing machine for washing items, said machine having an oscillating vertical axis agitator with a barrel portion, said accessory comprising:

a sleeve proportioned to be received over and in coaxial alignment with the barrel portion, vane means associated with the sleeve for urging items in the vicinity of said vane means in a downwardly direction, one-way clutch means operably connecting the agitator and the sleeve, said one-way clutch means comrising:

a plurality of teeth circumferentially spaced around the top of the sleeve, and a ratchet ring coaxially mounted on the barrel portion of the agitator to oscillate therewith, and above the top of the sleeve, said ratchet ring having a plurality of pawls downwardly directed about its periphery and engaging the teeth of said sleeve, the agitator having an agitator cap coaxial with and removably connected to the top of the agitator, the bottom of said agitator cap contacting the perimeter of the top of the ratchet ring to restrain the vertical movement of said ring.

7. An accessory as claimed in claim 5 wherein the vane means comprises at least one inclined vane rigidly affixed to and extending radially outwardly from the outer perimeter of the sleeve.

8. An agitator accessory for a washing machine having a washing receptacle for containing washing liquid and the items to be washed, an oscillating vertical-axis agitator centrally disposed within said washing receptacle, said agitator having a barrel portion and a skirt portion and said skirt portion carrying a plurality of substantially vertical vanes, said agitator accessory imparting a rollover action to the contents of said washing receptacle, and comprising:

a sleeve mounted coaxially with and over the barrel portion of the agitator, vane means associated with the sleeve for augering items to be washed in a downwardly direction, and one-way clutch means operably connecting the sleeve with the agitator to incrementally rotate said sleeve in one direction upon oscillatory movement of said agitator.

9. An agitator accessory claimed in claim 8 wherein the vane means comprises at least one inclined vane rigidly affixed to and extending radially outwardly from the outer perimeter of the sleeve.

10. An agitator accessory for a washing machine having a washing receptacle for containing washing liquid and the items to be washed, an oscllating vertical-axis agitator centrally disposed within said washing receptacle, said agitator having a barrel portion and a skirt portion and said skirt portion carrying a plurality of substantially vertical vanes, and means for imparting a rollover action to the contents of said washing receptacle, said accessory comprising:

a sleeve mounted coaxially with and over the barrel portion of the agitator, vane means associated with the sleeve for augering items to be washed in a downwardly direction, one-way clutch means operably connecting the sleeve with the agitator to incrementally rotate said sleeve in one direction upon oscillatory movement of said agitator, said one-way clutch means comprising: a plurality of teeth circumferentially spaced around the top of the sleeve, a ratchet ring coaxially mounted on the barrel portion of the agitator to oscillate therewith and above the top of the sleeve, said ratchet ring having a plurality of pawls downwardly directed about its periphery for engaging the teeth of said sleeve, and an agitator cap coaxial with and removably connected to the top of the agitator, the bottom of said agitator cap contacting the perimeter of the top of the ratchet ring to restrain the vertical movement of said ring.

11. An agitator accessory as claimed in claim 10 wherein the barrel portion of the agitator has a pair of vertical grooves formed on opposite sides of its upper portion, and wherein the ratchet ring has corresponding inwardly projecting tongues, such that said tongues ride in said grooves preventing relative rotational motion between said agitator and said ratchet ring.

12. An agitator accessory for a washing machine having a washing receptacle for containing washing liquid and clothes to be washed and a vertical axis agitator disposed within said receptacle, said agitator having a barrel portion, and a lower portion carrying a plurality of substantially vertical vanes, said agitator accessory including a sleeve adapted to be mounted on the barrel portion of said agitator for moving clothes in the receptacle in a rollover pattern during a washing operation, a radially outwardly extending helical vanes projecting from the sleeve for augering clothes downwardly of the agitator, and one-way clutch means for connecting the sleeve to the agitator for rotating the sleeve upon oscillation of the agitator.

13. An agitator accessory for use with an agitator mounted for oscillating movement about a vertical axis in washing fluid witin a fabric receiving receptacle of a clothes washing machine and including:

a unitary member including an upstanding center post portion and a lower vaned portion oscillatable about said vertical axis to effect the scrubbing of fabrics placed within said receptacle, said accessory comprising:

a sleeve member mounted on and encompassing said center post portion above said lower vaned portion and provided with helical vane means for engaging said fabrics, and clutch means drivingly interconnected between said sleeve member and said unitary member for imparting an intermittent unidirectional rotary movement to said sleeve member during the oscillation of said unitary member to provide a toroidal rollover movement of said fabrics about said vertical axis.

14. An agitator accessory for use with an agitator mounted for oscillating movement about a vertical axis in washing fluid within a fabric receiving receptacle of a clothes washing machine and icluding:

a unitary member including an upstanding center post portion and a lower vaned portion oscillatable about said vertical axis to effect the scrubbing of fabrics placed within said receptacle said accessory comprising:

a detachable sleeve member mounted adjacent said unitary member and encompassing said center post portion for movement relative thereto above said lower vaned portion, one-way clutch means drivingly interconnected between said sleeve member and said unitary member to incrementally rotate said sleeve in one direction upon oscillatory movement of said unitary member, and helical vane means mounted on said sleeve member for deflecting said fabrics downwardly adjacent said center post portion during the oscillation of said unitary member so as to impart a generally toroidal rollover movement to said fabrics about said vertical axis.

15. An agitator accessory for use in a vertical axis clothes washing machine having a receptcle for receiving fluid and fabrics and provided with an oscillatable agitator within said receptacle for agitation of said fluid and said fabrics, said accessory comprising:

a fabric deflecting member adapted for mounting adjacent said agitator for arcuate movement about the vertical axis of said agitator for urging fabrics placed in said machine into a circulatory path adjacent said agitator during arcuate movement of said fabric deflecting member, and means for effecting a substantially intermittent, unidirectional rotation of said fabric deflecting member during oscillation of said agitator to thereby produce a generally toroidal rollover action of said fabrics through the cooperative movement of said fabric deflecting member and said agitator.

16. An agitator accessory for use with an oscillatable agitator of a vertical axis washing machine, said accessory comprising:

a vaned member adapted to be mounted in coaxial alignment with said agitator for urging fabrics placed within said washing machine into engagement with said agitator, and means for intermittently drivingly interconnecting said vaned member with said agitator to effect a one-way drive therebetween.

* * * * *

UNITED STATES PATENT OFFICE

CERTIFICATE OF CORRECTION

Patent No. 3,987,652 Dated October 26, 1976

Inventor(s) Ernest Burlin Ruble

It is certified that error appears in the above-identified patent and that said Letters Patent are hereby corrected as shown below:

The drawing figure which appears on the cover sheet and firure 2 of the drawings should be deleted to appear as per attached figure 2.

Figure 1 of the drawing figure should be deleted to appear as per attached figure 1.

Signed and Sealed this

*Twenty-fourth* Day of *April 1979*

[SEAL]

*Attest:*

RUTH C. MASON
*Attesting Officer*

DONALD W. BANNER
*Commissioner of Patents and Trademarks*